US005192306A

United States Patent [19]

Scott et al.

[11] Patent Number: 5,192,306

[45] Date of Patent: Mar. 9, 1993

[54] CHIROPRACTIC MANIPLUATION TABLE WITH FLEXION/DISTRACTION HEADPIECE

[75] Inventors: Gerald R. Scott, Elmhurst, Ill.; James M. Cox, Fort Wayne, Ind.

[73] Assignee: Standex International, Salem, N.H.

[21] Appl. No.: 680,309

[22] Filed: Apr. 4, 1991

[51] Int. Cl.[5] ..... A61H 1/02

[52] U.S. Cl. ..... 606/243; 606/245; 5/608

[58] Field of Search ..... 128/70-75; 269/323, 328; 606/242-243, 245; 602/32, 33; 5/607, 608, 610

[56] References Cited

U.S. PATENT DOCUMENTS 4,221,213 9/1980 Gregory et al. .
4,243,025 1/1981 Jones .
4,655,200 4/1987 Knight .
4,722,328 2/1988 Scott et al. .
4,724,828 2/1988 Barnes et al. .

*Primary Examiner*—Richard J. Apley
*Assistant Examiner*—Linda C. M. Dvorak
*Attorney, Agent, or Firm*—Mason, Kolehmainen, Rathburn & Wyss

[57] ABSTRACT

A new and improved treatment table for supporting a patient in a face down prone position for chiropractic manipulation of the cervical vertebrae patient's spine includes a base extending upwardly of the floor to a convenient working level and a thoracic cushion for supporting a patient's body below the neck in the prone position at the work level. A headpiece is pivotally interconnected relative to the thoracic cushion for supporting the patient's head during manipulation treatment. The headpiece is pivotal about a laterally extending horizontal axis spaced at a level above the thoracic cushion and just below or at a level coincident with the patient's spine. The headpiece is also movable in lateral flexion about an upwardly extending axis and is rotatable about a roll axis generally coincident with the patient's spinal axis. Independent locks are provided for selectively locking or releasing the headpiece for movement about one or more of the respective axes at a particular time to effect a particular type of treatment. A height adjustable handle is mounted on the headpiece to facilitate the chiropractor in the manipulative treatment of the patient in flexion/distraction, lateral flexion, spinal rotation or selected combinations thereof such as circumduction. An occipital harness is provided for securing a patient's head in place on the headpiece for use when spinal traction is desired in connection with flexion/distraction treatment.

24 Claims, 8 Drawing Sheets

CHIROPRACTIC MANIPLUATION TABLE WITH FLEXION/DISTRACTION HEADPIECE

BACKGROUND OF THE INVENTION

1. Field of the Invention

The present invention relates to a new and improved chiropractic manipulation table and more particularly, a table especially designed for treatment of the cervical vertebrae of a patient while in a prone position supported on separate thoracic and headpiece cushions. A chiropractic manipulation table of the present invention provides additional capability for treating cervical vertebrae of a patient and is an improvement over the tables shown and described in U.S. Pat. Nos. 4,722,328 and 4,850,343 which are assigned to the same assignee as the present application.

2. Background of the Prior Art

U.S. Pat. Nos. 4,649,905 and 4,724,828 disclose chiropractic treatment tables having headpieces mounted and provided with multiple degrees of freedom of movement. However, a problem concerning these tables exist in that the headpieces are only movable about a lateral pivot axis which is spaced well below the level of the supporting cushions so that a only small amount of angular displacement about the axis tends to result in a large amount of stretching or pulling action on a patient's spine. Because of this arrangement, the amount of angular deflection is too limited to always effect proper treatment of a patient.

OBJECTS OF THE INVENTION

It is an object of the present invention to provide a new and improved chiropractic manipulation table of the character described and more particularly, a table having a movable headpiece especially designed for treatment and manipulation of the cervical vertebrae of a patient lying in a face down prone position on the table at a convenient working level.

Another object of the present invention is to provide a new and improved chiropractic table of the character described having a headpiece pivotally interconnected relative to a separate thoracic cushion for controlled pivotal movement about a laterally extending axis spaced above the supporting cushions at or below the level of the patient's spine so that excessive force or stress does not result upon relative angular movement of the headpiece to effect flexion/distraction treatment.

Yet another object of the present invention is to provide a new and improved chiropractic treatment table of the character described wherein the headpiece is relatively rotatable with respect to the adjacent thoracic support for lateral rotational movement about a vertical pivot axis and/or rotational movement about a longitudinal roll axis spaced above the cushions and generally coincident with the spinal axis of the patient.

Still another object of the present invention is to provide a new and improved chiropractic manipulation device of the character described which employs a height adjustable assist handle mounted on the headpiece for aiding a chiropractor in precisely controlled pivotal manipulation of the patient's head and cervical vertebrae during a variety of treatments.

Yet another object of the present invention is to provide a new and improved chiropractic manipulation table of the character described which is suitable for use in effecting flexion/distraction treatment of the cervical vertebrae, lateral flexion and spinal rotation and capable of providing circumduction movement and longitudinal traction utilizing a harness engaging occipital regions of a patient's head.

Another object of the present invention is to provide a new and improved chiropractic manipulation table as set forth in the preceding object having visual indicators for indicating the amount of angular displacement in spinal rotation, lateral flexion and flexion/distraction of the headpiece assembly.

Another object of the present invention is to provide a new and improved chiropractic manipulation table of the character described which includes a selectively adjustable resilient resistance system for counterbalancing the weight of a patient's head and headpiece of the table during angular manipulation about a horizontal lateral axis during flexion/distraction treatment.

Another object of the present invention is to provide a new and improved chiropractic manipulation table of the character described which includes a plurality of locks for selectively locking and releasing a headpiece for pivotal movement about one or more of several pivot axes and including an indicator for showing the amount of angular rotation about a longitudinal roll axis generally coincident with the spinal axis of the patient.

BRIEF SUMMARY OF THE PRESENT INVENTION

The foregoing and other objects and advantages of the present invention are accomplished in a new and improved chiropractic treatment table of the character described which is especially adapted for use in the treatment of the cervical vertebrae of a patient's spine while the patient is lying in a face down prone position at a convenient working level for a chiropractor. The table includes a thoracic support cushion and a separately supported headpiece pivotally interconnected for movement about a first laterally extending pivot axis spaced at a level above the cushions and at or below the level of a patient's spine so that a reasonable amount of angular rotation of the headpiece about the lateral pivot axis does not result in excessive stretching action or force being exerted on the spine. A height adjustable assist handle is mounted on the headpiece for aiding a chiropractor in manipulation of the headpiece and an adjustable resilient resistance mechanism is provided for counterbalancing the weight of a patient's head and the headpiece during rotation about a lateral axis extending through the patient's neck adjacent the chin and shoulders.

The table also includes additional pivots for permitting controlled pivotal movement of the headpiece relative to the thoracic support about a second axis extending upwardly to normally intersect the spine of a patient for lateral flexion and for pivotal movement about a longitudinal or rotational axis spaced above the table cushions and generally coincident with a patient's spine so that relative rotation between cervical vertebrae and/or discs can be effected. Locks are provided for selectively locking against rotation about any of the three axes and this affords a means for treating a patient's spine by manipulation of the headpiece in an orbital circumduction action which involves both lateral flexion and flexion/distraction movement. A harness is provided to secure the patient's head to the headpiece for exerting longitudinal tension or traction on the spine as flexion/distraction is accomplished so as to provide a traction force acting on a patient's cervical vertebrae.

BRIEF DESCRIPTION OF THE DRAWINGS

For a better understanding of the present invention, reference should be had to the following detailed description taken in conjunction with the drawings, in which.

DETAILED DESCRIPTION OF A PREFERRED EMBODIMENT OF THE INVENTION

Figure 1:
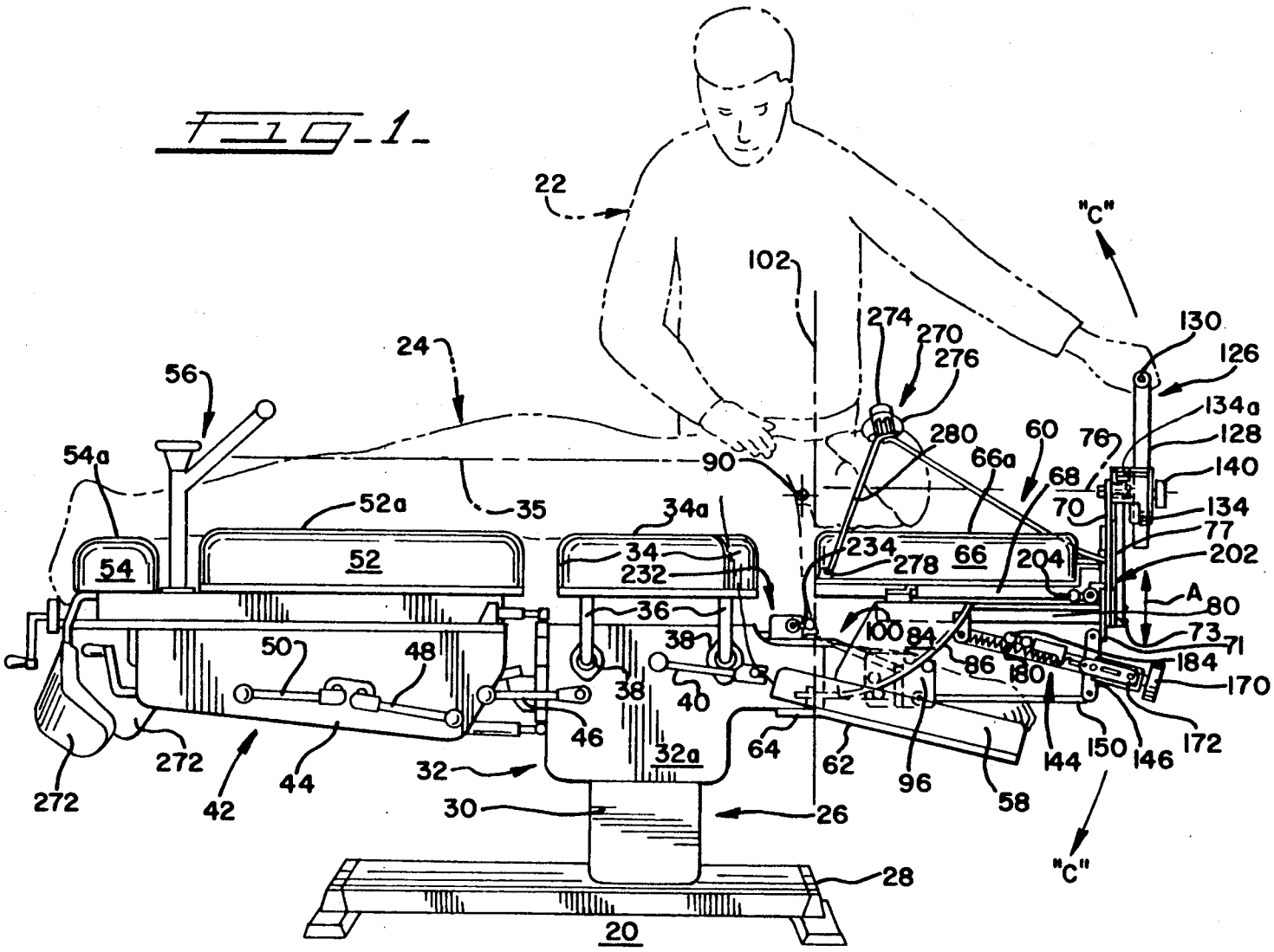
FIG. 1 is a side elevational view of a new and improved chiropractic manipulation table illustrating a patient supported in a face down prone position ready for angular movement of a pivotal headpiece to effect treatment of the cervical vertebrae.
Figure 2:
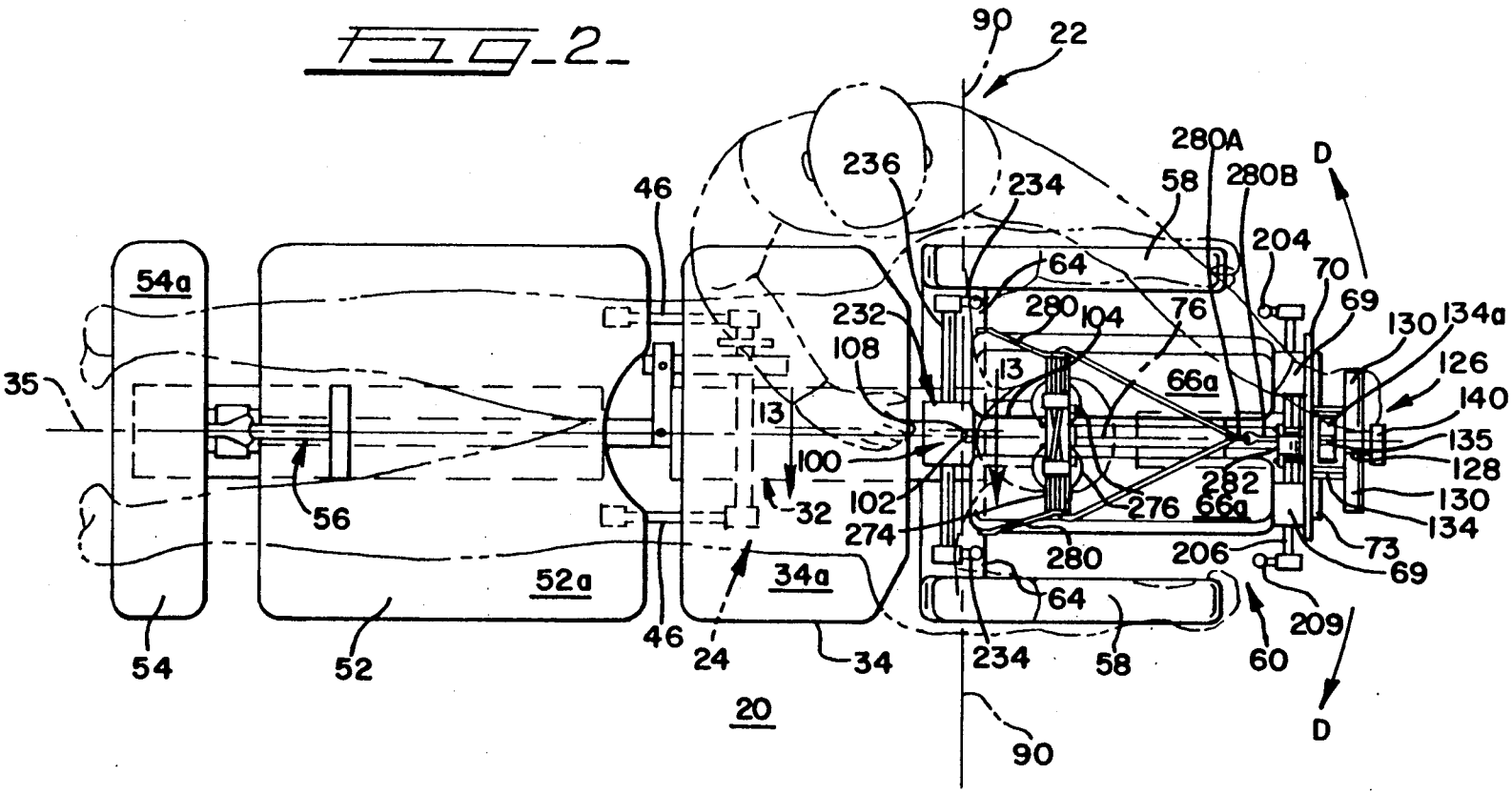
FIG. 2 is a plan view of the table looking downwardly thereon and illustrating the position of a chiropractor's arms and hands during the treatment of a patient lying on the table.

Referring now more particularly to the drawings, in FIGS. 1 and 2 is illustrated a new and improved chiropractic treatment table generally referred to by the reference numeral 20. The table 20 is especially designed and adapted for use by a chiropractor 22 in standing position, for manipulation and treatment of the cervical vertebrae of a patent 24 lying face down in a prone position and supported at a convenient working level for the chiropractor above the floor or other surface.

The table 20 is of the same general type as shown and described in U.S. Pat. Nos. 4,722,328 and 4,850,343, which patents are incorporated herein by reference, but also includes a number of novel improvements, particularly well adapted for treatment of the vertebrae in the cervical area as distinguished from the lumbar region. The table 20 includes a base structure 26 having a floor engaging horizontal foot portion 28 and an upstanding pedestal 30 on which is mounted an undercarriage 32 for supporting a thoracic cushion 34 having an upper surface 34*a* for supporting the patient's body below the arms and neck. As more fully described in the aforementioned U.S. patents, the thoracic cushion 34 is carried upon a pair of arcuate, laterally extending, tubular members 36 which project through gimbal mounted bearings 38 on opposite side walls 32*a* of the undercarriage 32. The thoracic cushion 34 is thus rotatable about a longitudinally extending axis 35 (FIG. 1) spaced above the upper surface 34*a* of the cushion 34 in a variety of different relative rotational positions and is lockable in a selected position by means of a lock controlled by a pair of lock handles 40 on opposite sides of the undercarriage 32 as more fully described in the aforementioned U.S. patents, incorporated herein by reference.

The table 20 also includes a leg or pelvic support section 42 having an undercarriage 44 pivotally interconnected with the undercarriage 32 to provide for angular manipulation of the patient's legs for treatment of the lower and lumbar vertebrae as described in the aforementioned patents. The pelvic support section 42 is provided with a plurality of locks, each lock including a pair of control handles 46, 48 or 50, respectively, on opposite sides of the undercarriages 32 and 44. The leg support section 42 includes an upper leg support cushion 52 having an upper surface 52*a* spaced below the axis 35 and an ankle support cushion 54 having an upper surface 54*a*. An assist bar 56 is also provided for easier manipulation of the leg support or pelvic support section 42 of the table as more fully described in detail in the aforementioned U.S. patents incorporated herein by reference.

In accordance with the present invention, the table 20 includes a new and improved flexion/distraction capable headpiece 60 especially designed to facilitate manipulative treatment of the patient's upper spine and cervical vertebrae in a variety of different chiropractic techniques. The headpiece 60 includes a pair of forwardly and downwardly extending armrests 58 supported on sloped base plates 62 secured to opposite ends of a laterally transversely extending crossarm 64. The headpiece 60 includes a pair of spaced apart longitudinally extending cushions 66 having upper surfaces 66*a* at substantially the same level as the upper surface 34*a* of the thoracic cushion 34 when both cushions are positioned in horizontal alignment as shown in FIG. 1. The cushions 66 are adapted to support the head of a patient 22 while lying face down in a prone position during treatment and each cushion 66 includes an elongated base 61 of plywood with a metal element 68 having a flange 69 at an outer or head end that is joined to an upwardly extending end plate 70 as best shown in FIG. 4.

Each cushion base 61 is supported at an inner end portion on an arcuately curved, laterally extending slide track 72 (FIGS. 3, 4 and 5) and a by a plate 70 at the outer or head end of the headpiece 60. The plate 70 is sandwiched between two pairs of low friction plastic bearing buttons 78 which are supported by an outer end wall 73 and an inner end wall 71 parallel thereto. The end plate 70 has a cantilevered pivot shaft 91 aligned on a roll axis 76 of the headpiece 60 and the pivot shaft is journaled in a bearing 93 at the upper end of a support 77 attached to the outer end wall 73. The headpiece is pivotable about the roll axis 76 with the assistance of an assist bar 126 as shown best in FIG. 4 (arrows "B").

Figures 3, 3A:
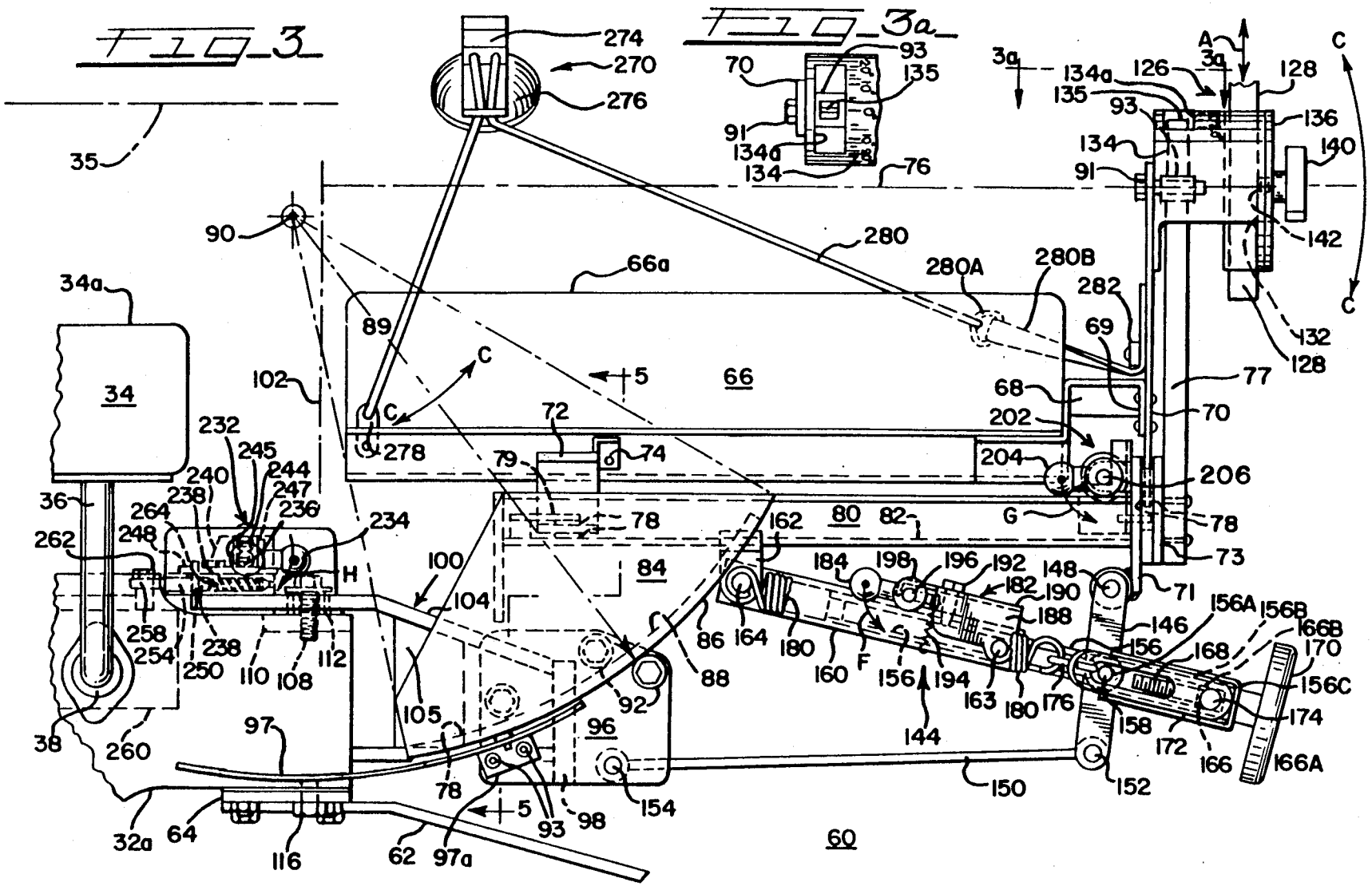
FIG. 3 is an enlarged side elevational view of a forward or head end part of the table illustrating a headpiece in accordance with the features of the present invention.
FIG. 3*a* is a fragmentary view looking in the direction of arrows 3*a* of FIG. 3.
Figure 4:
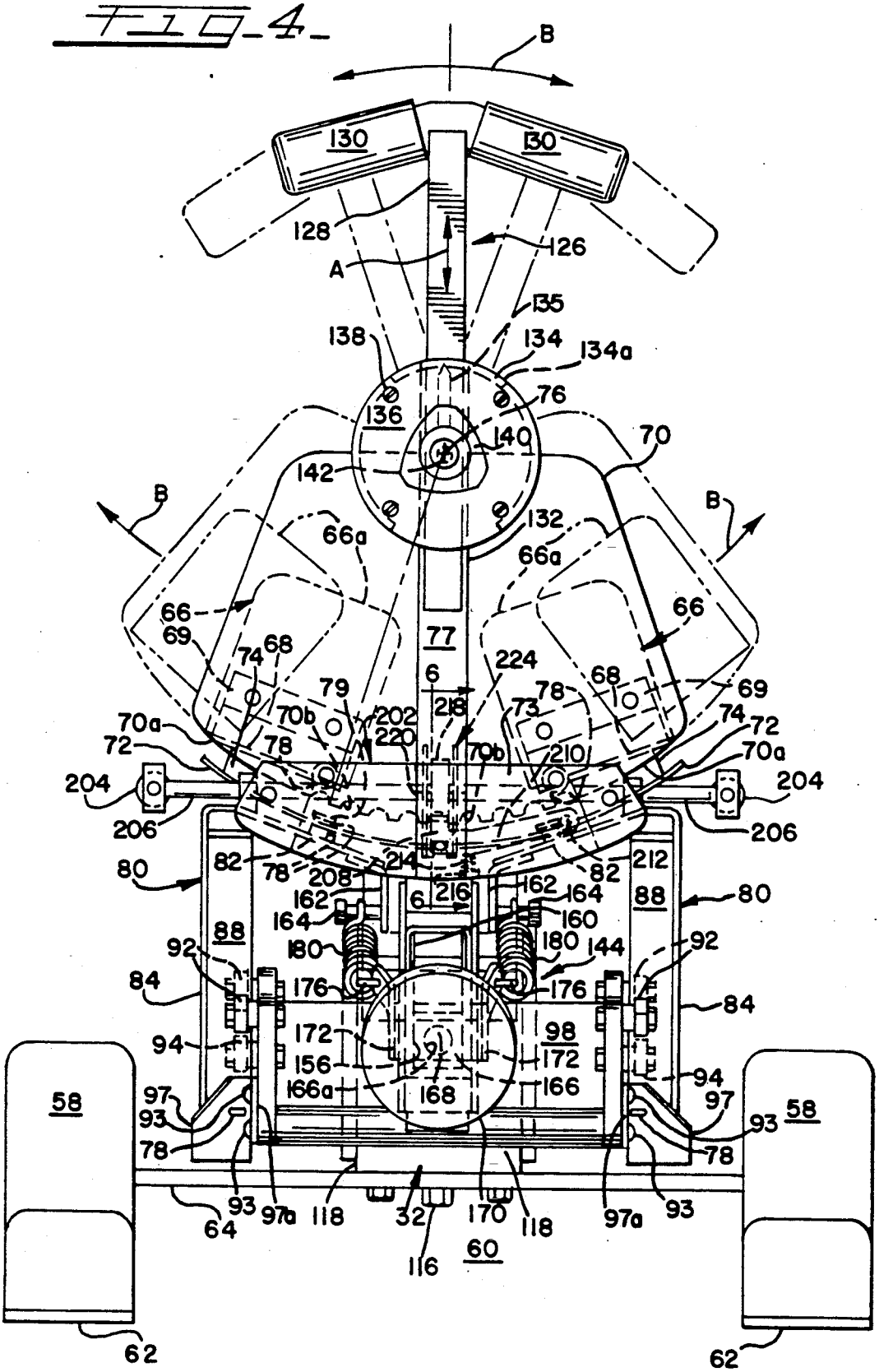
FIG. 4 is a head end elevational view of the table illustrating the headpiece and an assist handle in several relative rotative positions as shown in dotted

The slide track 72 is attached to the underside of each cushion base 68 by an angle bracket 74 and the track is curved in concentric alignment about a virtual roll axis 76 spaced above the upper surfaces 66*a* of the cushions 66 and centered therebetween as shown in FIG. 4. The roll axis 76 is generally coincident with the vertebrae in the neck and head of a patient 24 lying on the table 20 and is spaced approximately an inch below the axis 35 above the cushions 34, 52 and 54 when the headpiece 60 is in the horizontal position as shown in FIG. 1 while the respective cushion surfaces 66*a* and 34*a* are horizontally aligned as shown also in FIG. 3.

Figure 5:
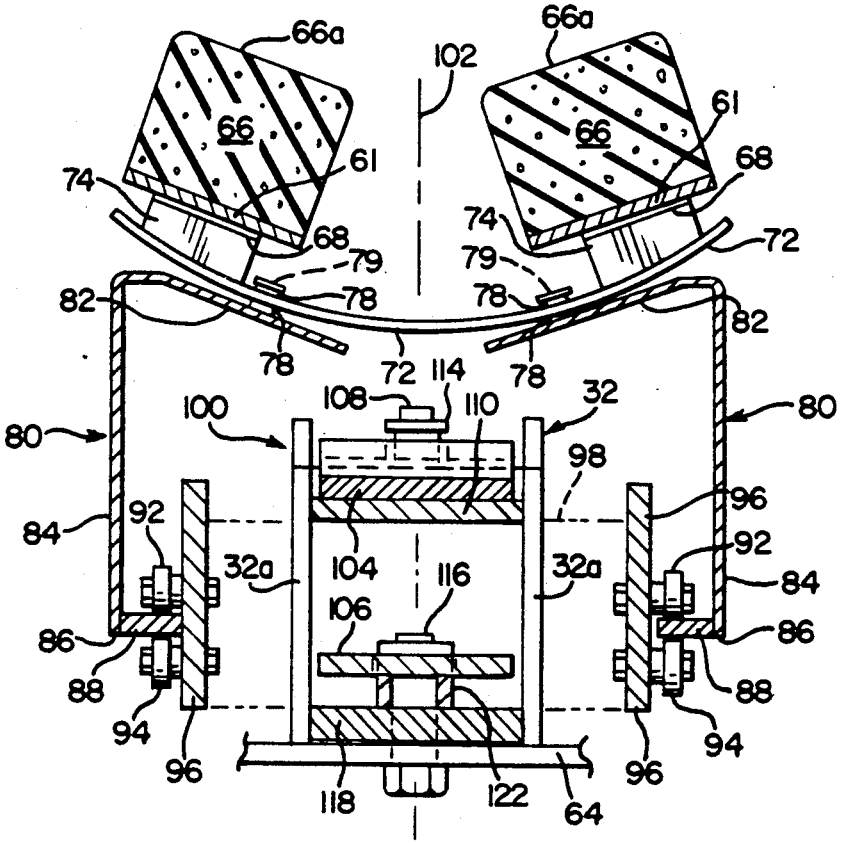
FIG. 5 is a transverse cross-sectional view taken substantially along lines 5—5 of FIG. 3.

The curved slide track 72 is supported for arcuate, laterally transverse sliding movement to obtain rotation about the roll axis 76 (FIG. 4) and is sandwiched between pairs of low friction, plastic bearing buttons 78 (FIGS. 3, 4 and 5). The upper button 78 of each pair is supported at the cantilevered end portion of a finger 79 in turn supported on a spacer block 81 mounted on the upper flange 82 of a respective elongated base element 80 of the headpiece 60. At a rearward end portion the base elements 80 are joined to a pair of parallel opposite side walls 84 each having an arcuately curved lower edge 86.

Figure 8:
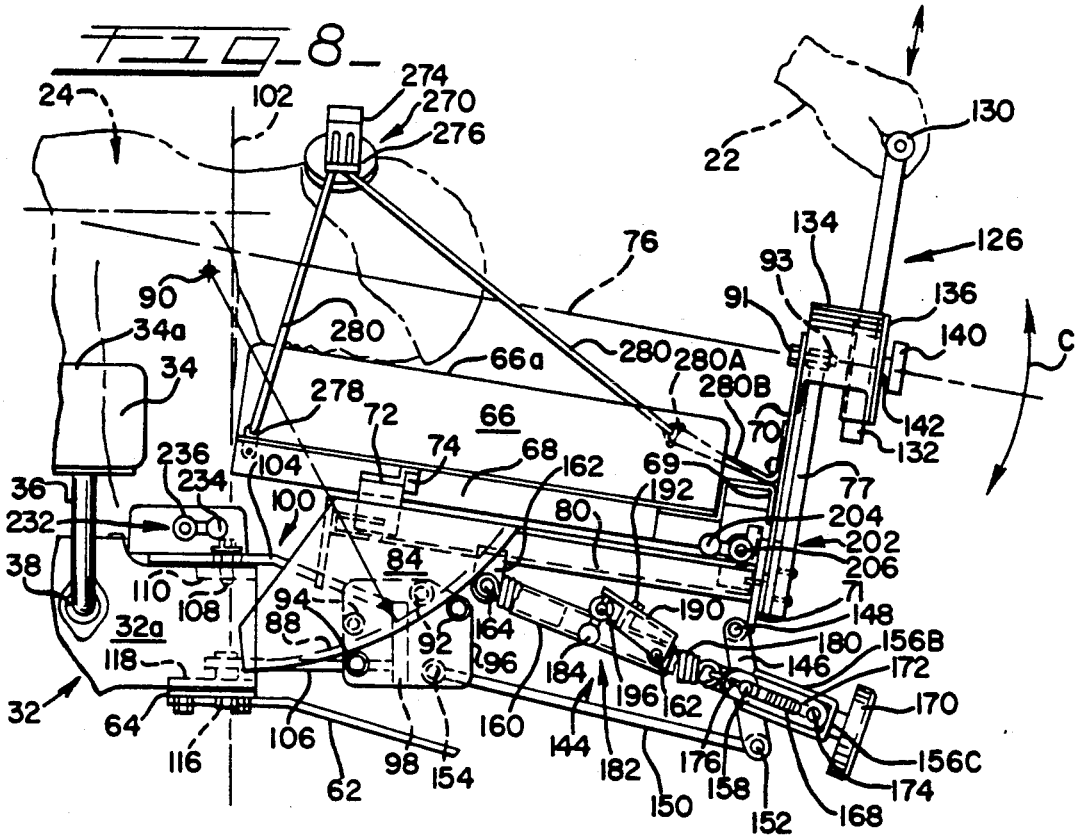
FIG. 8 is an enlarged fragmentary side elevational view of the head end portion of the table illustrating the adjustable counterbalancing mechanism.

Each side plate 84 includes an inwardly extending, arcuately curved, slide member 88 or track formed to have a radius of curvature 89 (FIG. 3) generated from a laterally extending, horizontal pivot axis 90 spaced at a level above the level of the upper cushion surfaces 34*a* and 66*a* and at or below the level of the longitudinally extending roll axes 35 and 76 of the table 20 and headpiece 60. As best shown in FIGS. 3 and 8, the lateral pivot axis 90 lies closely adjacent to the spinal axis of a patient 24 resting on the table. Accordingly, pivotal movement of the headpiece 60 about the lateral axis 90 does not produce excessive tension, movement or strain on the patient's spine even though a substantial degree of angular rotation of the headpiece out of the horizontal position, either upwardly or downwardly, is accomplished during treatment. The same is not true of prior art tables wherein the lateral axis of rotation of the headpieces is generally spaced a large distance below the upper surfaces of the patient supporting cushions of the table and the headpiece, and an even greater distance below the patient's spine.

In order to support the headpiece 60 for rotational movement about the lateral pivot axis 90 in both directions from a horizontal or neutral position for flexion/-distraction treatment, each curved slide member 88 is supported for sliding movement between a pair of upper, spaced apart rollers 92 and a pair of lower spaced about rollers 94 mounted on stub axles projecting outwardly at right angles from a pair of inner side plates 96 spaced inwardly and parallel of the respective outer side plates 84 as best shown in FIGS. 3 and 4.

The inner side plates 96 are secured to opposite ends of a relatively thick, laterally extending support bar 98 forming a forward end wall of a pivotal yoke structure 100 attached to a forward end portion of the central undercarriage 32 of the table 20 for lateral pivotal movement of the headpiece 60 about a generally upstanding or vertical pivot axis 102. The yoke structure 100 includes an upper tongue 104 projecting outwardly and sloping downwardly from a forward end portion of the undercarriage 32. A generally horizontally extended lower tongue 106 projects horizontally outwardly of the undercarriage 32 at a lower level on the forward end portion and both tongues are secured to the lateral bar 98 at the outer end and the bar is secured to the inner side plates 96 at opposite ends. A gusset 105 is secured between the upper and lower tongues 104 and 106 intermediate the ends thereof.

The spaced apart horizontal inner end portions of the tongues 104 and 106 are formed with concentrically aligned apertures in concentric alignment with the upstanding pivot axis 102 which generally intersects or is close to the horizontal roll axis 35 at a point of intersection closely aligned with a patient's spine and a slight bit forward of the laterally horizontal pivot axis 90. The upper tongue 104 of the yoke structure 100 is pivotally secured by an upper pin 108 having a threaded lower end extending into a threaded aperture provided in a top plate 110 on the base 32. The top plate 110 is secured at an upper level on the undercarriage 32 and extends between the opposite vertical side plates 32*a*. A thrust washer 112 is mounted between the upper surface of the top plate 110 and the lower surface of the upper tongue 102 and a bushing 114 is seated on the pin 108 to provide free pivotal support for the yoke structure 100 to turn or rotate in place about the axis 102. The lower tongue 106 of the yoke structure 100 is secured by a lower threaded pin 116 projecting upwardly from the transverse base member 64 through an opening provided in a forward portion of a lower plate wall section 118 of the undercarriage 32 extending transversely between the opposite side walls 32*a*. A bushing 122 is mounted on the pin 116 above the lower plate 118 below the lower tongue 106 to provide for free-swinging pivotal movement of the headpiece 60 about the upwardly extending axis 102.

In accordance with the present invention, the table 20 is provided with an upwardly extending assist bar or assist handle 126 mounted at the outer or head end of the headpiece 60 for aiding a chiropractor 22 in manipulative treatment of a patient 24. The assist handle 126 includes an upstanding leg 128 which is adjustable in a direction normal to the roll axis 76 as indicated by the arrows "A" in FIGS. 1, 4 and 8. At the upper end, the assist handle 126 is provided with a pair of laterally extending, downwardly sloping opposite hand grips 130 designed to be conveniently grasped by the hands of a chiropractor 22 for manipulation of the headpiece 60. The leg 128 is formed of hollow metal tubing and is slidably disposed in a similarly cross-sectioned but larger hollow sleeve 132 attached diametrically to a cylindrical drum 134 mounted on the outside of the end plate 70. The drum 134 includes a circular outer end wall 136 secured to the body of the drum by a plurality of equilaterally spaced fasteners 138.

The drum 134 is formed with a window 134*a* in an upper wall portion thereof exposing the upper end of an indicating pointer 135 having a pointed tip to indicate the amount of angular rotation of the headpiece 60 about the axis 76. Angle markings of 20° and 10° on both sides of a centered or 0° mark are provided (FIG. 3*a*) on the surface of the drum 134 along an edge of the opening 134*a* to provide a chiropractor with an instantaneous reading of angular roll deflection relative to the pointer 135.

An adjustment knob 140 provided with an inwardly extending threaded stem 142 is threadedly engaged in a centrally located threaded aperture provided in the circular end wall 136 so that an inner end of the stem 142 may be tightened or loosened to engage and hold or release an adjacent wall of the hollow leg 128 to secure the height of the hand grips 130 at any desired level. An inner end portion of the stem 142 extends through an enlarged aperture provided in the outwardly facing side wall of the hollow sleeve 132 so that the inner end face of the threaded stem will positively press and clamp into engagement against the slidable leg 128 and hold the leg in any selected height position desired upon tightening of the knob 140.

Lateral pressure applied to the assist handle 126 on the upper hand grips 130 as indicated by the arrows "B" in FIG. 4 will cause the headpiece 60 and cushions 66 thereof to rotate about the longitudinal roll axis 76 of the headpiece as previously described, and vertical forces applied to the assist handle 126 will cause the headpiece 60 to pivot up and down in a flexion/distraction type of motion about the laterally extending horizontal pivot axis 90 as indicated by the arrows "C" in FIGS. 1, 3 and 8. Similarly, lateral movement of the assist handle 126 from side to side will cause the headpiece 60 to pivot about the upstanding vertical axis 102 as indicated by the arrows "D" in FIGS. 2 and 12.

Figure 12:
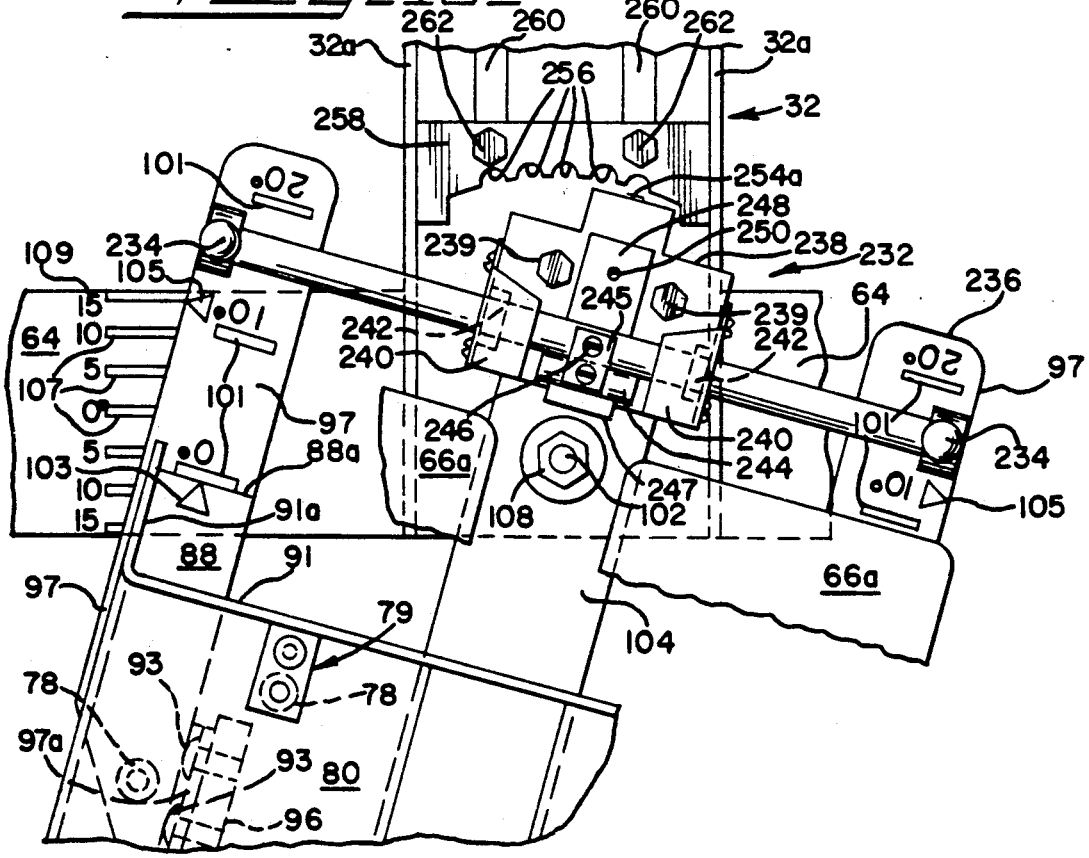
FIG. 12 is a plan view similar to FIG. 11 illustrating the lock mechanism in an unlocked position and showing relative angular rotation between a thoracic support cushion and the headpiece of the table.

Referring to FIGS. 3, 4 and 12, in order to prevent objects from inadvertently being positioned in the spaces between the lateral crossarm 64 and the movable side plates 84 and curved tracks 88 during pivotal action of the headpiece 60 about the lateral axis 90 and the vertical axis 102, the headpiece 60 is provided with a pair of arcuately curved combination guard indicators 97 (FIGS. 3 and 12) positioned outwardly of the side plates 84 and supported from the respective inner side plates 96 and attached to a crossarm 91 having outer end portions 91*a* normal to the central body of the crossarm. Plastic bearing buttons 78 are provided between the upper surface of the guard indicators 97 and the lower surface of the respective tracks 88 and between the mounting brackets and base elements 80 to provide for smooth low friction movement between the respective guard indicators 97 and the adjacent tracks 88.

In accordance with the present invention, the upper surface of the guard indicators 97 which serve as guards or finger protectors are provided with angle indicating indicia 101 for displaying the amount of angular deviation about the lateral axis 90 when the headpiece 60 is moved to provide flexion/distraction manipulation. The indicia 101 are read against an end 88*a* of the tracks 88 that is marked or emphasized by triangular-shaped markers 103 (FIG. 12).

The guard indicators 97 also serve to display the amount of angular displacement of the headpiece 60 relative to the vertical axis 102 and for this purpose are provided with triangular-shaped markers 105 along the outer edge (FIG. 12). The markers 105 are movable relative to a plurality of line marks 107 identified with numbers 109 representing different angles of lateral deviation of the headpiece 60 relative to the vertical axis 102 and the longitudinal axis 35 of the table 20 as a whole. The marks 107 and numbers 109 are provided on the upper surface of the crossarm 64 on opposite outer end portions.

It is thus seen that a user of the table 20 and unique headpiece 60 are provided with an instantaneous display of the amount of angular deviation or position of the headpiece 60 relative to any or all of the axes 76, 90 and 102. The unique guard indicators 97 function both as guards to protect against injury during manipulation of the headpiece 60 and at the same time provide visual indicators for providing a display of angular deviation.

In accordance with the present invention, the headpiece 60 includes an adjustable counterbalancing assembly 144 interconnected between the side plates 96 of the yoke structure 100 and a lower portion of the outer end of the headpiece base elements 80. The counterbalancing assembly 144 includes a pair of laterally spaced apart links 146 pivotally connected at their upper ends to a cross pin 148 secured to the lower edge of the inside end plate 71. The lower ends of links 146, in turn, are pivotally interconnected to the outer end of a thrust member 150 by a lower pivot pin 152. An inner or rearward end of the thrust member 150 is secured to a cross pin 154 extending between the inner side plates 96 of the yoke structure 100. When the headpiece 60 is in a generally horizontal position as shown in FIGS. 1 and 3, the links 146 hang generally downwardly and the thrust member 150 occupies a generally horizontal position at right angles to the links. When the headpiece 60 is pivoted downwardly as illustrated in FIG. 8, the angle between the links 146 and the thrust member 150 becomes acute and when the headpiece 60 is pivoted upwardly from the horizontal position, the angle between the links 146 and the thrust member 150 becomes obtuse.

Figure 9:
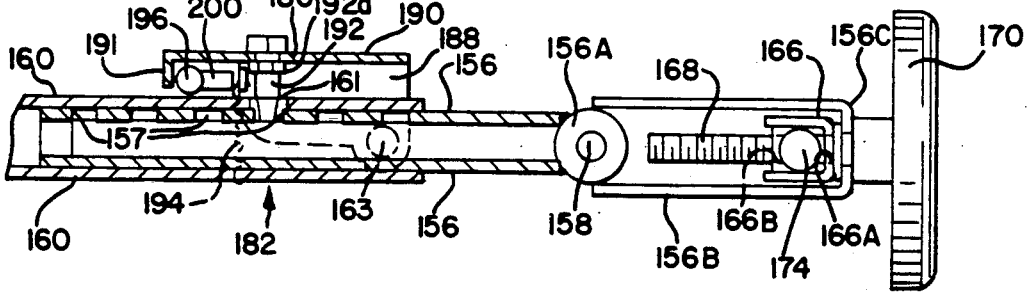
FIG. 9 is a fragmentary enlarged longitudinal cross-sectional view of an adjustable lock of the counterbalancing mechanism shown in a selected locked position.

A pair of elongated, spaced apart blade elements 156 extend between the links 146 and are pivotally secured thereto by a cross pin 158. The blade elements 156 are mounted for sliding longitudinal movement within an outer sleeve 160 of hollow tubular construction and pivotally interconnected at its inner end to a pair of downwardly extending ears 162 and a cross pin 164 extending through the ears and outwardly thereof on opposite sides. As best illustrated in FIG. 9, it will be seen that the blades 156 and tubular element 160 are disposed in longitudinal sliding movement, one within the other, as indicated by the arrows "E". As best shown in FIGS. 3 and 4, the ears 162 are attached to the underside of the flanges 82 on the base elements 80 and project downwardly in parallel relation to support the cross pin 164 and the inner end of the elongated hollow, tubular element 160 for pivotal movement about an axis transverse to the length of the table.

As best seen in FIGS. 3 and 9, the outer end portions of the inner blade elements 156 are joined to a transversely extending hollow tube section 156A which journals a cross pin 158. A U-shaped extension 156B extends outwardly of the tube 156A to provide a thrust surface 156C at the outer end to engage a hand wheel 170 mounted on a jack screw 168. The U-shaped extension 156B is parallel of and extends longitudinally outwardly of the spaced apart blades 156. A slide channel 166 (see FIG. 9) provided with an axial bore 166A in the bight portion thereof supporting a plastic nut 166B to receive the threaded screw 168 which is slidably mounted in the extension 156B. The outer end of the screw 168 is connected to the rotatable, hand wheel 170 for selectively controlling the counterbalancing force exerted on the head piece support cushions 66 and patient's head by the adjustable suspension system 144.

A middle cross pin 158 supports the blades assembly including the blades 156 and the channel extension 156B for pivotal movement about the axis of the cross tube 156A at a location approximately midway between the cross pin 148 and the pivot pin 152. The slide block 166 is mounted outwardly of the links 146 for sliding movement within the central portion of the tubular channel extension 156B.

When the hand wheel 170 is turned in one direction, the slide channel 166 will move inwardly toward the links 146 and when turned in the opposite direction, the slide block 166 will move outwardly towards the hand wheel as the threaded shaft 168 is rotated and the block 166 will move in the opposite direction upon reverse rotation of the hand wheel. The slide channel 166 is connected to a pair of slotted link members 172 mounted on opposite sides of the tubular channel element 156B by a pair of outwardly projecting cross pins 174. At the inner ends (FIG. 4), the slotted links 172 are bent outwardly in opposite directions and are connected through links 176 to a pair of elongated tension springs 180 disposed on opposite sides of the elongated, hollow, outer tube 160. Inner ends of the tension springs 180 are connected to the cross pin 164 so that the springs tend to bias the inner blades 156 of the blade assembly inwardly towards the cross pin 164.

By rotating the hand wheel 170, the amount of tension bias exerted by the springs 180 can be adjusted and these forces, in turn, are applied to the link members 146 via the cross pin 158. Thus, downward pivotal movement of the headpiece 60 in the direction of arrow "C" from the horizontal position as shown in FIG. 3, causes the distance between the pins 164 and 158 to elongate and this stretches the springs 180 which then exert more tension against further downward movement. Upward pivotal movement of the headpiece 60 about the lateral flexion/distraction axis 90 in the direction of arrow "C" (FIG. 3) tends to reduce the spacing or distance between the cross pins 164 and 158 and reduces the tension on the spring 180. By selective adjustment of the hand wheel 170, the amount of force exerted by the counterbalancing assembly 144 is precisely controllable and, in this manner, patients having different body weights and sizes can be accommodated so as to minimize the manipulative force in the vertical direction required of a chiropractor 22 using the table 20 when providing flexion/distraction treatment of the cervical vertebrae.

Figure 10:
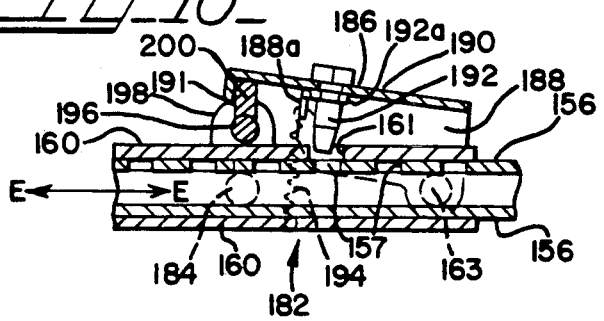
FIG. 10 is a view similar to FIG. 9 showing the look in an unlocked position.

In accordance with the present invention, the headpiece 60 is also provided with a lock mechanism 182 (FIG. 3) controllable by a pair of lock levers 184 on opposite sides of the table 20. As best shown in FIGS. 8, 9 and 10, the lock mechanism 182 is designed to lock or release the blades 156 of the blade assembly which are mounted for longitudinally slidable movement in the outer tubular element 160 of the adjustable counterbalance assembly 144. When locked, the headpiece 60 is restrained against pivotal movement about the lateral axis 90 and when released, the headpiece 60 is movable to pivot about the lateral axis 90 such as manipulated by a chiropractor and indicated by the arrows C.

The lock mechanism 182 includes a base element 186 having a pair of depending side walls 188 on opposite sides of the outer tube 160 and pivotally secured thereto by pivot axles 163 so that the base can pivot between a locked position of FIG. 9 and an unlocked position as shown in FIG. 10. In the locked position, a top wall 190 of the base 186 is parallel to a top wall of the tube 160 and in an unlocked position as shown in FIG. 10, the top wall 190 slopes upwardly towards the left.

A threaded lock pin 192 is mounted on the top wall 190 and is secured in place by a jam nut **192*a*. The lock pin includes a tapered lower end adapted to project into a selected one of a series, of longitudinally spaced apart holes 157 provided in the elongated blade members 156. A single hole 161 is provided in the upper wall of the outer tube 160 to accommodate the lock pin. Normally, the lock mechanism 182 is biased to the locked position of FIG. 9 by a pair of elongated coil springs 194, each having a lower end connected to the outer tube 160 and an upper end connected to a tab 188*a* on a side wall 188 of the lock base 186**.

The control levers 184 are mounted at the opposite outer ends of an elongated control shaft 196 extending transversely across the top wall of the elongated tube 160 and supported for rotary movement in a pair of upstanding bearing flanges 198. The shaft 196 is provided with a radial arm 200 at the center, which arm is pivotally movable from the horizontal, locking position of FIG. 9, (arrow F, FIG. 3) to an upstanding, unlocking position of FIGS. 8 and 10 wherein the outer edge of the arm engages the underside of the top wall 190 of the latch base 186 and pivots the latch base about the pins 162 to retract the latch pin 192 from the slot 157 in the inner tube 156.

When retraction is completed as shown in FIG. 10, the inner blade assembly and blades 156 are freely longitudinally slidable in the tube 160 until the latch 182 is again locked by rotary movement of the operating handles 184 back from a vertically downwardly extending position toward a horizontal position. When the lock mechanism 182 is in the released or unlocked position of FIG. 10, the headpiece 60 can be pivoted about the lateral, horizontal axis 90 (as indicated by the arrows "C") in an up or down direction as desired and the amount of counterbalancing force offered by the springs 180 can be adjustably controlled by the hand wheel 170. The headpiece 60 can also be fixed in a locked position relative to the lateral flexion/distraction axis 90 in one of several angular positions as determined by which of the slots 157 the lock pin 192 is engaged in.

The counterbalancing assembly 144 and the lock mechanism 182 are thus cooperative and selectively effective to permit angular manipulation of the headpiece 60 about the lateral axis 90 or to lock the headpiece in a selected angular position relative to the other support surfaces **34*a*, 52*a*, 54*a* of the table 20. Moreover, the amount of tension exerted by the springs 180 can be selectively controlled by the hand wheel 170 to provide the desired amount of resistance to pivotal movement when pivotal manipulation is desired during the treatment of the patient 24 on the table 20**.

When the control handles 184 are aligned with the outer tubular member 160, the lock pin 192 is engaged in a selected hole 157 on the blades 156 of the blade assembly. Rotation of the handle 184 as illustrated by the arrow "F" in FIG. 3, elevates the tapered end of the lock pin 192 upwardly above the holes 157 so that longitudinal movement of the telescoping tube members 156 and 160 can be accomplished as illustrated by the arrows "E" in FIGS. 9 and 10 until a new hole is positioned beneath the hole 161 in the outer tube 160. If the handles 184 are then rotated back to the original locked position, the springs 194 are effective to again seat the tapered end of the lock pin 192 in a selected hole 157 to provide the desired degree of fixed angular adjustment between the headpiece cushion surfaces **66*a* and the adjacent thoracic support cushion surface 34*a***.

In a headpiece 60 constructed in accordance with the invention, five or six holes or slots 157 are provided in the upper, inner blade member 156 and this results in a range of flexion/distraction pivotal action to +10° above the horizontal to −20° down below the horizontal. This angular range is ample to treat cervical vertebrae problems in a flexion/distraction type of manipulative therapy.

In accordance with the present invention, the headpiece 60 is also provided with a roll lock system 202 as best illustrated in FIGS. 3, 4, 6 and 7, which employs a pair of control handles 204 on opposite ends of a laterally extending control shaft 206. When the handles 204 are in the flat position as shown in FIGS. 1, 3, 4 and 8, the roll locking mechanism 202 is retained in a locked position so that pivotal movement about the roll axis 76 is prohibited. When the handles 204 are rotated in a counterclockwise direction as shown in FIG. 3 by the arrow "G" toward a downwardly extending condition, the locking mechanism 202 is unlocked for permitting angular pivotal adjustment about the headpiece roll axis 76 as indicated by the arrows "B" in FIG. 4.

Figure 6:
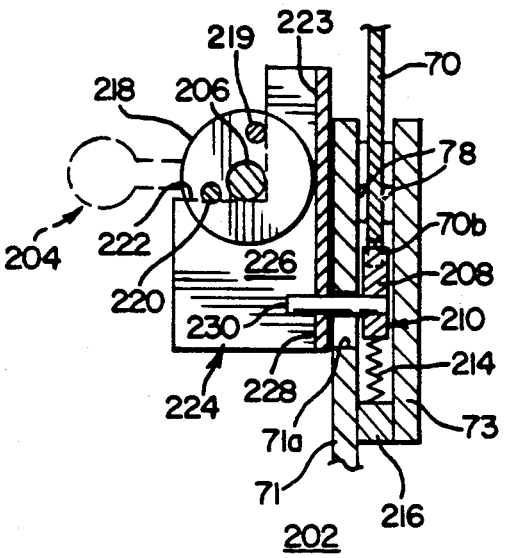
FIG. 6 is a fragmentary cross-sectional view taken substantially along lines 6—6 of FIG. 4 showing a lock mechanism in a locked position.

As previously indicated, the arcuately curved lower edge 70*a* of the end plate 70 is formed with a plurality of grooves or notches 70*b* spaced along the arcuate surface between the outer portions 70*a* of the curved edge. The notches are adapted to receive an upwardly extending latch element 208 formed on the end of a latch lever 210 (FIG. 4) pivotally mounted on a pivot pin 212 extending between the inner and outer end plates 71 and 73. As viewed in FIG. 4, the latch arm 210 is biased in a rotary direction by a spring 214 beneath the arm and resting on a spacer block 216. The spring normally biases the arm 210 and the latch element 208 into an upwardly extending, latching position into engagement with a selected notch or groove 70*b* in the end plate 70 as shown in FIGS. 4 and 6.

In order to unlatch the roll lock mechanism 202 so that roll angle adjustment about the axis 76 may be accomplished, the control shaft 206 is provided with a circular cam disc 218 mounted at the center thereof and the disc is provided with a pair of eccentric stop pins 219 and 220 (FIGS. 6 and 7) adapted to engage an upper cam surface 223 and a vertical cam surface 222 formed on side walls 226 of a channel-shaped slide 224 and serve as rotary travel stops. The L-shaped side walls 226 are disposed on opposite sides of the circular disc 218 as shown in FIG. 4. The channel slide 224 is thus slidable in a vertical direction and is contained by engagement of the opposite side walls 226 against the opposite side surfaces of the cam disc 218.

The channel slide 224 includes a web 228 extending between the opposite side walls 226 and bearing against the inside face of the rear end plate 71. The web 228 is connected to the latch portion 208 of the lever 210 through a cross pin 230 so that movement of the channel slide will, in turn, pivot the lever 210 and move the latch 208 into and out of engagement with a selected notch or slot 70*b* on a lower curved edge 70*a* of the end plate 70. A connecting cross pin 230 extends through a vertical slot 71*a* provided in the inner end wall 71 and upper and lower edges of the slot limit the travel of the channel slide 224 in a vertical direction.

Figure 7:
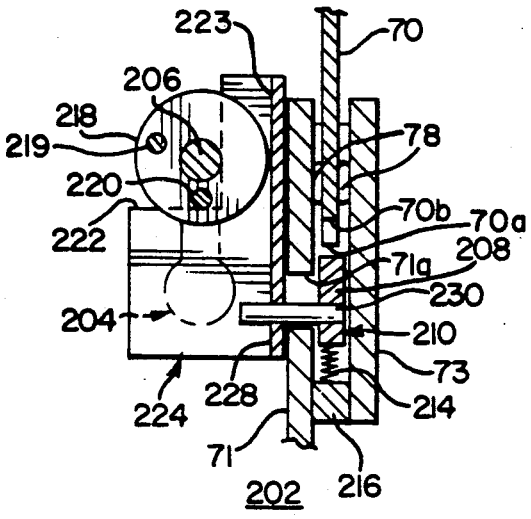
FIG. 7 is a fragmentary cross-sectional view similar to FIG. 6 showing the lock mechanism in an unlocked position.

When the control handles 204 are pivoted downwardly and out of the generally aligned position with the headpiece base element 80, the roll lock system 202 is moved to an unlocked condition as shown in FIG. 7, and when so unlocked, the headpiece 60 is free to rotate about the roll axis 76 as indicated by the arrows "B" until it is again desired to latch or lock the headpiece against rotation in a fixed position with respect to the axis 76.

In a headpiece 60 constructed in accordance with the present invention, a total of four notches or slots 70*b* were provided on either side of a centrally positioned slot and each slot is positioned to provide a 5° angular displacement relative to the next adjacent slot so that the headpiece, as a whole, can be rotated a total of 20° to either side out of a vertical position about the roll axis 76. Each notch 70*b* outwardly of a center notch would represent a 5° increment of angular displacement.

When the lock handles 204 are positioned in the downwardly depending position, the roll locking system 202 is released to an unlocked condition as shown in FIG. 7 and continuous rotative manipulation of the headpiece 60 about the axis 76 can be attained by lateral force applied to the assist handle 126 as indicated by the arrows "B" in FIG. 4. If continuous roll treatment is not desirable, the roll lock mechanism 202 can be returned to a locked position by moving the handles 204 to the aligned position as shown in FIGS. 1 and 3 and the headpiece is thus no longer rotatable about the roll axis 76.

Referring now more particularly to FIGS. 3 and 11–13, the table 20 is provided with a lateral or side to side, pivot lock system 232 for locking and unlocking the headpiece 60 for selected rotation about the upstanding vertical pivot axis 102 so that lateral flexion/distraction type of treatment can be accomplished when desired. The lateral lock system includes a pair of handles 234 on opposite sides of the table mounted on a transverse control shaft 236 extending laterally across the table at a level above the tongue 104 of the yoke mechanism 100 as shown in FIG. 3. The lateral lock system 232 includes a base member 238 secured by cap screws 239 on a rearward end portion of the tongue 104 behind the supporting pivot pin 108. The base 238 includes a pair of upstanding side bearing members 240 each having a collar 242 mounted adjacent thereto and secured to the shaft 236 to prevent longitudinal sliding movement of the shaft during rotation.

At the center of the shaft 236, an actuating element 244 is secured to extend radially outwardly of the shaft with a plate 245 and cap screws 246. The actuator 246 is adapted to engage an upstanding tang 247 at the end of a latch actuator 248 slidably disposed on the upper surface of the base 238.

Figure 13:
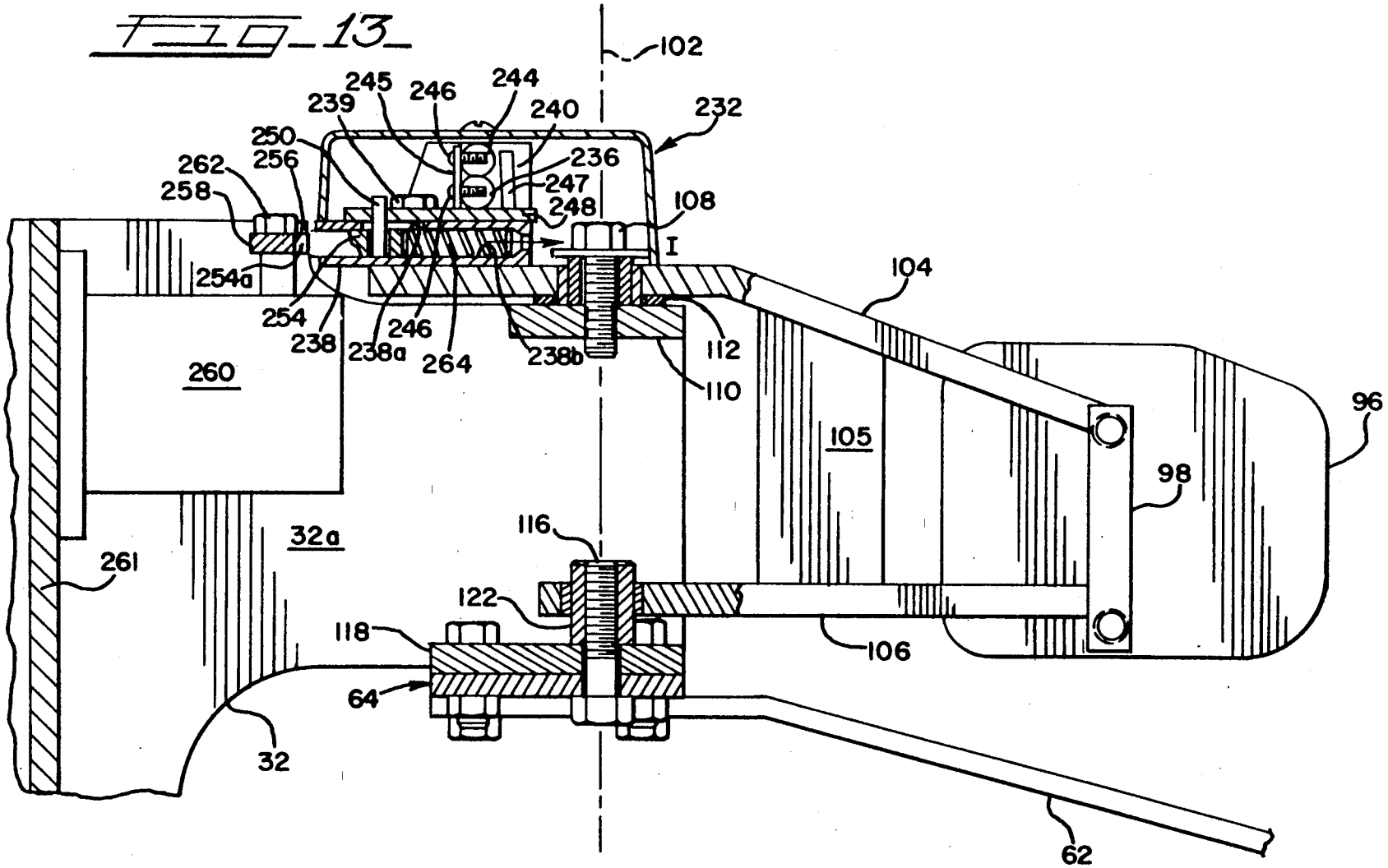
FIG. 13 is an enlarged fragmentary vertical cross-sectional view taken substantially along lines 13—13 of FIG. 2.

The latch actuator 248 supports a downwardly projecting pin 250 mounted for sliding movement in a slot 238*a* formed in the base 238 (FIG. 13). The pin 250 engages a latch 254 having a projection 254*a* at the outer end adapted to latchingly engage a selected one of several slots or grooves 256 formed on a curved, forwardly facing edge of a horizontal, fixed latch element 258. The latch element 258 is attached to a pair of ribs 260 mounted on a cross-member 261 at the forward end portion of the undercarriage 32 and is secured in place thereon by a pair of cap screws 262.

Figure 11:
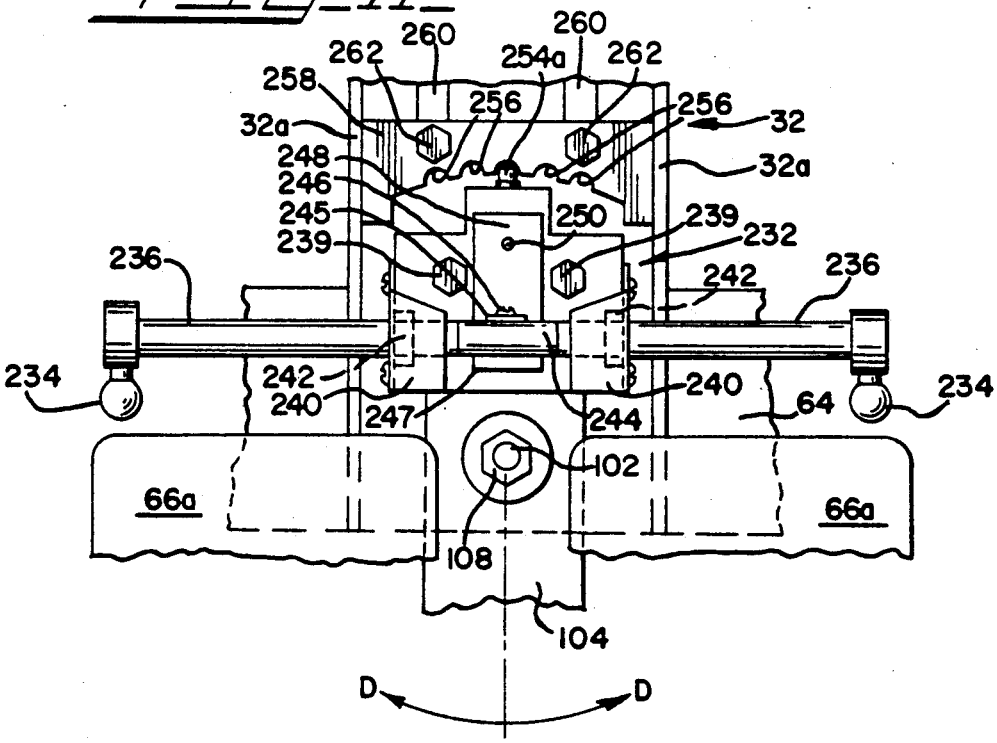
FIG. 11 is a fragmentary plan view illustrating a lock mechanism for selective locking of the rotational action of the headpiece about an upwardly extending axis.

Referring to FIGS. 11–13 and FIG. 3, when the latch projection 254*a* is engaged in one of the grooves 256 on the fixed latch element 258, the headpiece 60 is locked against rotation about the upstanding pivot axis 102. The headpiece may be locked in one of several positions depending upon which of the grooves 256 is engaged by the latch projection 254*a*. In an embodiment constructed in accordance with the present invention, the recesses or notches 256 provided for a total of 15° of lateral swing (arrow D) from either side of a centrally aligned neutral position as shown in FIG. 11. This provides a total of 30° of angular lateral flexion manipulation possible with the headpiece 60 when the latch mechanism 232 is unlocked.

Referring to FIG. 13, the latch element 254 is biased to a latched position towards the foot end of the table 20 by means of a coil spring 264 mounted in a longitudinal bore 238b formed in the base 238. As best illustrated in FIG. 3, when either control handle 234 is rotated from the horizontal position as indicated by the arrow "H" to a vertical position, the arm 244 on the shaft 236 engages the tang 247 and retracts the latch actuator 248 in the direction of arrow "I" (FIG. 13) so that the latch projection 254*a* moves out of engagement with a slot 256 on the fixed latch member 258. With the handles 234 in the vertical position, angular lateral manipulation of the headpiece 60 as indicated by the arrows D of FIGS. 2, 11 and 12, is accomplished and a total of 30° of pivotal action around the upright axis 102 can be obtained when desired. In addition, the headpiece 60 can be latched in a selected one of several notches 256 so as to provide a centrally aligned or neutral position as shown in FIG. 11 or an angularly displaced position on either side of the central axis 35 of the table in 7.5° angular increments.

For latching or locking, the control handles 234 may be pivoted from the vertical position to each horizontal position of FIGS. 1, 3 and 11 to relatch the headpiece 60 in a desired lateral position with respect to the table axis 35.

It will thus be seen that the latch levers 184, 204 and 234 for controlling the lock systems of the headpiece 60 are accessible from both sides of the headpiece 60 and the table 20. When in a generally horizontal or aligned position as shown in FIG. 3, the headpiece is firmly locked against pivotal movement about any of the three axes including the roll axis 76, the vertical axis 102 or the horizontal, lateral axis 90. When any of the handles 184, 204 or 234 are pivoted to the generally vertically extending positions as previously described and indicated by the arrows "F", "G" and "H", the headpiece 60 is freely pivotal about the roll axis 76, the upwardly extending, vertical axis 102 or the lateral, horizontal axis 90 to provide for combinations of controlled pivotal movement for flexion/distraction treatment about the lateral, horizontal axis 90, lateral flexion action about the vertical axis 102 or roll deflection about the roll axis 76. One or more of the lock mechanisms can be locked as desired to limit the rotational movements or treatment to less than all of the three degrees or axes of freedom.

In a treatment known as circumduction, the headpiece 60 is locked by the mechanism 202 about the roll axis 76 but is pivotal about the lateral pivot axis 90 and the vertical axis 102 to provide for orbital 35 manipulation wherein the patient's head is moved in a closed orbital pattern relative to the axis 35 to provide a combination of flexion/distraction treatment about the lateral axis 90 and lateral or side to side, flexion about the vertical axis 102.

In addition to the aforementioned treatments, the table 20 is also provided with a head restraint harness 270 for securing a patient's head against the cushion surfaces 66*a* of the headpiece 60 so that longitudinal traction forces may be applied to the spine of the patient 24 during lateral flexion or flexion/distraction manipulation. At the same time, the patient's ankles may be restrained by ankle harnesses 272 positioned adjacent the ankle cushions 54 in a manner more fully described in the aforementioned patents incorporated herein by reference.

The head restraint harness includes an elongated, laterally extending cross member 274 on which are mounted a pair of spaced apart circular pad members 276 designed to engage and press downwardly against occipital regions on the back side of a patient's head on either side of the spine. The cross member 274 is restrained downwardly and tensioned by means of a flexible cord 280 extending upwardly from attachment ears 278 on opposite base elements 68 adjacent the inner end of the headpiece 60 on the outside edges of the cushions 66. The attachment cords 280 extend from opposite ears 278, cross over one another on the back side of the cross arm 274 and extend from the cross arm forwardly and downwardly to converge in a "D" ring element 280A. A web belt 280B secured to the "D" ring 280A passes through a latch element 282 mounted at the center of the end plate 70 on the inside face thereof. The cross-member 274 is adjusted and positioned by sliding movement relative to the cords 280 until suited for a particular patient and treatment involved. Frictional forces between the cord segments crossing from side to side in the cross member 274 resist accidental movement during treatment. This arrangement provides a secure means for holding the patient's head in a desired position centered with respect to the spaced apart cushion surfaces 66*a* when manipulation treatment takes place.

The table 20 and the novel headpiece 60 thus provides for a wide variety of chiropractic operations and/or manipulation therapy techniques to be utilized for treating the upper or cervical vertebrae. Selective treatments can be effected in a variety of different types and combinations of pivotal movements as described.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A treatment table for supporting a patient while lying in a face down generally horizontal prone position for chiropractic manipulation of the patient's spine said table comprising:

a base projecting upwardly of the floor toward a convenient working level;

first support means on said base having an upwardly facing first support surface for supporting a patient's body below the neck while lying on said table for treatment adjacent said working level;

second support means having an upwardly facing second support surface for supporting the patient's neck and head and spaced apart from said first support surface along a central longitudinal axis of said table; and first pivot means for pivotally interconnecting said first and second support means for controlled relative rotational movement about a first axis extending generally horizontal and transverse with respect to said central longitudinal table axis, said first axis positioned at a level spaced above and proximate to said first support surface wherein said first axis is positioned substantially at or beneath the level of the patient's spine while lying on said table.

2. The treatment table of claim 1, including:

second pivot means for providing lateral, side to side pivotal movement of said second support means relative to said first support means about a second axis extending generally upwardly through said central longitudinal table axis.

3. The treatment table of claim 2, wherein:

said first and second axes substantially intersect one another at a point aligned with the central longitudinal table axis.

4. The treatment table of claim 2, including:

third pivot means for providing rolling pivotal movement of said second support means relative to said first support means along a third axis extending generally horizontal in the same general direction as said central longitudinal table axis and at a level space above said first and second support surfaces.

5. The treatment table of claim 4, wherein:

said first, second and third axes are close to intersecting one another.

6. The treatment table of claim 1, including:

upwardly extending handle means on said second support means spaced from said first axis for manipulation of said second support means in said controlled relative rotational movement.

7. The treatment table of claim 6, wherein:

said handle means includes means for selectively adjusting the height thereof above said second support means.

8. The treatment table of claim 2, including:

lock means for selectively securing said second support means against relative rotation movement about one or both of said first and second pivot axes as selected.

9. The treatment table of claim 4, including:

lock means for selectively securing said second support means against relative rotational movement about one or more of said first, second and third pivot axes as selected.

10. The treatment table of claim 1, including:

flexible strap means for providing cervical traction by engagement against a back side of the patient's head for holding the patient's head against said second support surface in a selected position on said second support means while lying on said table during said controlled relative rotational movement.

11. The treatment table of claim 1, including:

first visual indicator means for displaying angular displacement between said first and second support means around said first axis.

12. The treatment table of claim 2, including:

second visual indicator means for displaying angular displacement between said first and second support means around said second axis.

13. The treatment table of claim 3, including:

third visual indicator means for displaying angular displacement between said first and second support means around said third pivot axis.

14. The treatment table of claim 13, including:

second visual indicator means for displaying angular displacement between said first and second support means around said second pivot axis; and wherein said second and third visual indicator means are positioned close to one another to facilitate viewing of both at the same time by a chiropractor during manipulation of the patient laying on said table.

15. The treatment table of claim 14, wherein at least one of said second and third indicator means includes a:

guard for shielding against positioning of foreign objects in a space defined between said first and second support means during said pivotal movement.

16. A treatment table for supporting a patient lying face down in a generally horizontal position for manipulative chiropractic treatment of the patient's spine comprising:

base means extending upwardly of a floor surface toward a convenient working level;

first cushion means having an upper first surface for supporting a patient's thorax while lying in a prone position on said table;

second cushion means separate from said first cushion means and having an upper second surface for supporting the patient's head, said first and second surfaces being spaced apart along a central longitudinal axis of said table;

first pivot means for supportively interconnecting said first and second cushion means for relative rotational movement about a first pivot axis, said first pivot axis extending transversely of said central longitudinal axis of said table in a generally horizontal direction and spaced at a level above said upper first surface of said first cushion means;

lock means for locking said first and second cushion means against said relative rotational movement and unlockable to permit said rotational movement; and handle means extendable upwardly of said second cushion means spaced adjacent an end portion of said second cushion means away from said pivot means and said first cushion means for facilitating said rotational movement while said lock means is unlocked.

17. The treatment table of claim 16, wherein:

said first pivot axis is spaced at a level between said first cushion means and the spine of the patient lying face down on said table for treatment.

18. The treatment table of claim 16, including:

second pivot means for permitting relative rotational movement between said first and second cushion means about a longitudinal second axis extending generally parallel to said central longitudinal table axis and spaced at a level above said upper first surface of said first cushion means.

19. The treatment table of claim 18, including:

indicator means for indicating the amount of relative rotation between said first and second cushion means about said second axis.

20. The treatment table of claim 19, including:

lock means for securing said first and second cushion means in a selected relative rotational position about said second axis.

21. The treatment table of claim 16, including:

third pivot means for permitting lateral relative rotational movement between said first and second cushion means about a third, upwardly extending pivot axis generally perpendicular to said central longitudinal table axis.

22. The treatment table of claim 21, including:

lock means for securing said first and second cushion means in a selected relative rotational position about said third axis.

23. The treatment table of claim 16, including:

counterbalancing means for supporting a patient's weight during relative rotational movement between said first and second cushion means about said first pivot axis.

24. The treatment table of claim 23, including:

adjustment means for selecting the amount of force exerted by said counterbalancing means for specific patients.

* * * * *